US007706732B2

(12) United States Patent
Kamei et al.

(10) Patent No.: US 7,706,732 B2
(45) Date of Patent: Apr. 27, 2010

(54) IMAGE FORMING APPARATUS WITH INCREASED TRANSFER EFFICIENCY

(75) Inventors: Yukikazu Kamei, Chiba (JP); Hiroshi Doshoda, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 575 days.

(21) Appl. No.: 11/642,675

(22) Filed: Dec. 21, 2006

(65) Prior Publication Data

US 2007/0147910 A1 Jun. 28, 2007

(30) Foreign Application Priority Data

Dec. 22, 2005 (JP) ..... P2005-370755

(51) Int. Cl.
*G03G 15/16* (2006.01)

(52) U.S. Cl. ..... 399/307

(58) Field of Classification Search ..... 399/307
See application file for complete search history.

(56) References Cited

U.S. PATENT DOCUMENTS

| | | | | |
|---|---|---|---|---|
| 5,782,730 | A * | 7/1998 | Kawasaki et al. | 492/56 |
| 6,212,352 | B1 | 4/2001 | Kagawa et al. | |
| 6,970,675 | B1 * | 11/2005 | Yoshino et al. | 399/307 |
| 7,257,360 | B2 * | 8/2007 | Domoto et al. | 399/328 |
| 2004/0037595 | A1 * | 2/2004 | Takashi et al. | 399/307 |
| 2006/0120776 | A1 | 6/2006 | Takashi et al. | |

FOREIGN PATENT DOCUMENTS

| | | | |
|---|---|---|---|
| JP | 63-34572 | A | 2/1988 |
| JP | 11-194631 | A | 7/1999 |
| JP | 2002-258630 | A | 9/2002 |
| JP | 2002-365934 | A | 12/2002 |
| JP | 2004-109762 | A | 4/2004 |
| JP | 2004-145260 | A | 5/2004 |
| JP | 2005-189612 | A | 7/2005 |
| JP | 2005-189693 | A | 7/2005 |
| JP | 2005-215247 | A | 8/2005 |

* cited by examiner

*Primary Examiner*—David M Gray
*Assistant Examiner*—Ruth N Labombard
(74) *Attorney, Agent, or Firm*—Birch, Stewart, Kolasch & Birch, LLP

(57) ABSTRACT

In an image forming apparatus, toner primarily transferred to an intermediate transfer belt is secondarily transferred at a first nip area formed by a secondary transfer roller and a transfuse roller, onto the transfuse roller, at pressure of 5.3 N/cm$^2$ to 20 N/cm$^2$ and at a driving speed ratio of the intermediate transfer belt and the transfuse roller of 1.02 to 1.04, and the toner sufficiently heated and melted in the process of conveyance from the first nip area to a second nip area formed by the transfuse roller and a pressure roller is thirdly transferred and fixed to a recording medium P at the second nip area, at pressure of 13.3 N/cm$^2$ to 33.3 N/cm$^2$.

6 Claims, 4 Drawing Sheets

IMAGE FORMING APPARATUS WITH INCREASED TRANSFER EFFICIENCY

CROSS-REFERENCE TO RELATED APPLICATION

This application claims priority to Japanese Patent Application No. JP 2005-370755, which was filed on Dec. 22, 2005, the contents of which, are incorporated herein by reference, in their entirety.

BACKGROUND OF THE INVENTION

1. Field of the Invention

The present invention relates to an image forming apparatus according to an electrophotographic process.

2. Description of the Related Art

Image formation according to the electrophotographic process is widely employed in copying machines, printers, facsimile apparatuses and so on. In image formation according to the electrophotographic process, a photoreceptor having a photosensitive layer which is formed on a surface thereof and contains a photoconductive substance is used. After the surface of the photoreceptor is uniformly charged by giving electric charges, an electrostatic latent image corresponding to image information is formed through various image forming processes, the electrostatic latent image is developed with toner supplied from a developing device to be a toner image, and the resultant toner image is transferred and fixed to a recording medium such as a recording sheet.

In order to improve the quality of an image transferred and fixed to a recording medium, and improve transfer efficiency that is a ratio of the amount of toner transferred onto a recording medium to the amount of toner of a toner image formed on a photoreceptor, various transfer methods and fixing methods have been proposed up to now.

As an example of such transfer methods can be given a transfer method comprising the steps of: transferring a toner image formed on a photoreceptor onto a primary transfer medium; transferring the toner image transferred to the primary transfer medium to a secondary transfer medium having a heat source inside; and transferring and fixing the toner image transferred to the secondary transfer medium to a recording sheet that is a recording medium (refer to Japanese Unexamined Patent Publication JP-A 63-34572 (1988).

According to the technique disclosed in JP-A 63-34572, it is possible, by preheating toner on the secondary transfer medium, to sufficiently heat the toner before transferring to a recording medium. According to the technique, by making the temperature of the toner reach the neighborhood of a critical interface temperature on the secondary transfer medium, and then transferring and fixing the toner to a recording medium, namely, a recording sheet at a fixing nip area, it is possible to secure a fix level at a relatively low fixing temperature even in a high-speed system machine. Moreover, according to the technique, adoption of a non-electric field transfer system (a thermal transfer system using heat) makes it possible to increase transfer efficiency at the time of transferring a toner image from the primary transfer medium to the secondary transfer medium as compared with a case where a conventional electric field transfer system is adopted, and makes it possible to obtain an image of higher quality with less toner scattering.

However, the technique disclosed in JP-A 63-34572 has a problem as described below. In the technique disclosed in JP-A 63-34572, a silicone RTV (room temperature vulcanizable) belt having good surface smoothness is used as the primary transfer medium, and a heating roller having a diameter of 120 mm provided with silicone RTV on an aluminum (Al) core metal having a halogen lamp inside is used as the secondary transfer medium.

In the technique disclosed in JP-A 63-34572, toner is transferred from the photoreceptor belt to the primary transfer medium, from the primary transfer medium to the secondary transfer medium, and from the secondary transfer medium to a recording sheet. In a case where silicone RTV is used as a material of a surface layer of the transfer medium, when toner is transferred from the primary transfer medium to the secondary transfer medium by thermal transfer, the toner is likely to stick and remain on the silicone RTV surface of the primary transfer medium, and division of toner, namely, toner offset occurs at a nip area between the photoreceptor belt and the primary transfer medium, because toner releasability of silicone RTV is insufficient.

In a case where division of toner, namely, toner offset occurs, part of the toner remains on the primary transfer medium, and toner for forming a toner image later gets short, with the result that there arises a problem such that image quality decreases. Moreover, also when a toner image is transferred from the secondary transfer medium to a recording sheet, because of the insufficient releasability, toner offset occurs, and toner remains on the secondary transfer medium, with the result that there arises a problem such that image quality significantly decreases.

To solve such a problem of decrease in image quality due to toner offset in an ordinary fixing system, it is necessary to apply a liquid having releasability such as silicone oil to the silicone RTV in order to increase toner releasability. However, in a so-called two-stage transfusing system as disclosed in JP-A 63-34572 that thermally transfers from the photoreceptor belt to the primary transfer medium and then from the primary transfer medium to the secondary transfer medium and thereafter transfers and fixes to a recording sheet, there is an adverse effect by application of the silicone oil, that is a problem of oil contamination of the photoreceptor belt and a developing portion with the silicone oil.

The cause of the above is that due to contact of the primary transfer belt and the photoreceptor belt with each other, the oil reaches the photoreceptor belt from the primary transfer medium and adversely affects formation of an electrostatic latent image and formation of a toner image at the time of development. Further, since the oil also reaches the inside of a development tank through the photoreceptor belt, there is also a problem such that a failure in development is induced.

There is another adverse effect such that due to existence of the silicone oil having good releasability at a nip area between the primary transfer medium and the secondary transfer medium, the secondary transfer medium acquires high releasability from the silicone oil, and thermal transfer of toner from the primary transfer medium to the secondary transfer medium in a good condition is impossible. That is to say, there is a problem such that a thermal transfer property is significantly impaired.

In the technique disclosed in JP-A 63-34572, in order to avoid the problems resulting from use of the oil, a release agent that gives releasability is added into a developer. By adding a release agent into a developer, it is possible to realize an oilless system that allows transferring and fixing without applying silicone oil to a transfer medium and a fixing roller. However, in the case of adopting the oilless system, it is usual to form the surfaces of the transfer medium and the fixing roller with tubes made of a copolymer of tetrafluoroethylene and perfluoroalkyl vinyl ether (abbreviated to PFA) or coat the surfaces with PFA. In the case of using a developer to which a release agent is added and obtaining desired releasability, it is actually difficult to use a surface material other than PFA.

Since the silicone RTV illustrated as an example of the material of the surface layers of the primary and secondary transfer mediums in the technique disclosed in JP-A 63-34572 has poor releasability, it is presumed that decrease in image quality due to the poor releasability occurs on the primary transfer medium or on the secondary transfer medium even if a developer into which a release agent is added is used.

Further, the technique disclosed in JP-A 63-34572 also has a problem as described below from the perspective of power saving.

At present, by the request for improvement of image formation efficiency, a color copier, a multifunction peripheral and so on are required to have a process speed of about 200 mm/sec to 400 mm/sec in general. However, generally, in the case of using the high-speed process as described above, the maximum power consumption far exceeds 1.5 kVA (100V, 15 A) that is an allowable limit of electric power of a commercial power source. Therefore, it becomes necessary to prepare a large-capacity power source when using a high-speed process machine in an ordinary office, home and so on.

Power consumption of a fixing portion forms the largest proportion in the details of power consumption of an image forming apparatus, and it is necessary to set a fixing temperature high in order to prevent occurrence of toner offset when continuously printing a plurality of sheets at a high speed, with the result that the power consumption tends to further increase.

Further, since the number of sheets of image formation per unit time is large in the case of the high-speed process, heat of the surface of the fixing roller is removed by recording sheets while the recording sheets are continuously passing, the temperature of the surface of the fixing roller rapidly decreases, and it takes long hours before the temperature returns to a predetermined fixing temperature. In short, there is a problem of so-called decrease of a heat follow-up property.

A conventionally used fixing system is a system in which after a toner image is transferred onto a recording sheet by the electrostatic action in a transfer portion, a recording sheet is conveyed to a nip area formed between a pair of heated rollers (a roller pair that is composed of a fixing roller having a halogen lamp inside to heat and a pressure roller pressing and contacting the fixing roller, and that forms a nip between the rollers), and toner is melted and fixed to the recording sheet at the nip area. In this system, increase of the heat follow-up property against decrease of the fixing temperature while sheets are continuously passing is attempted by making a rubber layer of the surface of the fixing roller thin, or selecting a lamp of high wattage as the heating lamp installed in the fixing roller.

Accordingly, in the high-speed process machine, in order to sufficiently fix while satisfying an offset property, a heat source of high wattage is installed, heating efficiency is increased by making a diameter of the fixing roller large, and a fixing nip width is secured by winding an endless belt serving as a pressure member on the fixing roller so as to abut.

The technique disclosed in JP-A 63-34572 adopts a method of using the heating roller having a large diameter of 120 mm as the secondary transfer medium that transfers and fixes transferred toner to a transfer sheet. In a case where the heating roller has a large diameter of 120 mm, a space between the halogen lamp and the Al core metal serving as a roller core metal is too large, and hence, heat transfer efficiency is bad, and it takes much time to increase the temperature. Further, since a surface area of the secondary transfer medium is large, the amount of heat radiated from the secondary transfer medium into the air is large, and heating loss is large. Accordingly, use of a large-diameter roller as in the technique disclosed in JP-A 63-34572 runs counter to energy saving because loss of electric power increases, and causes a problem such that the aim of adoption of a transfuse system to fix at a high speed with small power consumption is not fully achieved.

Further, since a time required for transfer of a toner image is short in the high-speed process, transfer efficiency is as low as 85% to 95%, the efficiency of use of toner is bad, and the amount of waste toner is large, which leads to a lot of waste. Therefore, in the high-speed process, it is desired to increase transfer efficiency and decrease waste toner production.

SUMMARY OF THE INVENTION

An object of the invention is to provide an image forming apparatus capable of transferring and fixing a toner image of high quality in a high-speed process, and forming an image having a good fixed level even at a relatively low fixing temperature by increasing transfer efficiency to reduce waste toner production.

The invention provides an image forming apparatus comprising:

a toner image bearing member provided in an image forming section for forming a toner image containing toner of one or two or more colors, for carrying the toner image;

an intermediate transfer section to which the toner image is primarily transferred from the toner image bearing member;

a transfuse section to which the toner image is secondarily transferred from the intermediate transfer section and which thirdly transfers and fixes the transferred toner image to a recording medium; and a secondary transfer member disposed so as to press against the transfuse section through contact with the intermediate transfer section, wherein pressure at a first nip area as a pressure-contact area formed by the transfuse section and the secondary transfer member pressing against the transfuse section through contact with the intermediate transfer section is in a range of from 5.3 $N/cm^2$ to 20 $N/cm^2$, and the transfuse section and the intermediate transfer section are configured to be driven at such speeds that a driving speed of the intermediate transfer section is higher than a driving speed of the transfuse section.

Further, in the invention, it is preferable that a ratio of the driving speed of the intermediate transfer section to the driving speed of the transfuse section is in a range of from 1.02 to 1.04.

According to the invention, in the image forming apparatus that primarily transfers a toner image from the toner image bearing member to the intermediate transfer section, secondarily transfers the toner image from the intermediate transfer section to the transfuse section, and thirdly transfers and fixes the toner image from the transfuse section to a recording medium, the pressure at the first nip area formed when the secondary transfer member disposed so as to press against the transfuse section through contact with the intermediate transfer section and the transfuse section press against each other is set to fall in a range of from 5.3 $N/cm^2$ to 20 $N/cm^2$, and the transfuse section and the intermediate transfer section are configured to be driven at such speeds that the driving speed of the intermediate transfer section is higher than the driving speed of the transfuse section, where the ratio of the driving speed of the intermediate transfer section to the driving speed of the transfuse section is preferably set to fall in a range of from 1.02 to 1.04. Since the pressure at the first nip area and the driving speed ratio of the intermediate transfer section and the transfuse section are thus set in favorable ranges, it becomes possible to increase the efficiency of transfer of toner from the intermediate transfer section to the transfuse section and decrease waste toner production, and transfer a toner image without causing decrease in image quality.

Further, in the invention, it is preferable that the transfuse section includes a transfuse roller to which a toner image is secondarily transferred from the intermediate transfer section, and the transfuse roller has at least a rubber layer, and the rubber layer has a hardness of 70 through 90 degrees in Asker C.

According to the invention, the transfuse section includes the transfuse roller to which a toner image is secondarily transferred from the intermediate transfer section, the transfuse roller has at least the rubber layer, and the hardness in Asker C of the rubber layer is set to 70 through 90 degrees. Consequently, the rubber layer is elastically deformed and can exhibit a good follow-up property to asperities on a surface of a recording medium, with the result that it is possible to prevent occurrence of micro-offset, and exert a scraping-off force of scraping off toner by shear deformation of the rubber layer, thereby realizing highly efficient transfer.

Furthermore, in the invention, it is preferable that the transfuse roller has a surface layer made of a copolymer of tetrafluoroethylene and perfluoroalkyl vinyl ether.

According to the invention, the transfuse roller has, on the surface layer, the application layer made of a copolymer of tetrafluoroethylene and perfluoroalkyl vinyl ether (expressed with an abbreviation of PFA hereafter), whereby a thin surface layer having excellent releasability is realized. Consequently, existence of the PFA application layer does not hinder elastic deformation of the transfuse roller, and the rubber layer of the transfuse roller can maintain a good follow-up property to asperities on a surface of a recording sheet, with the result that it is possible to prevent occurrence of micro-offset, and exert a scraping-off force of scraping off toner by shear deformation of the rubber layer, thereby realizing highly efficient transfer.

Still further, in the invention, it is preferable that the transfuse section includes a pressure member pressing against the transfuse roller, and pressure at a second nip area as a pressure-contact area formed by the transfuse roller and the pressure member pressing is in a range of from 13.3 $N/cm^2$ to 33.3 $N/cm^2$.

According to the invention, the transfuse section includes the pressure member pressing against the transfuse roller, and the pressure at the second nip area that is the pressure-contact portion formed when the pressure member presses against the transfuse roller is set to fall in a range of from 13.3 $N/cm^2$ to 33.3 $N/cm^2$. Consequently, it is possible to extend the life of the transfuse roller, and prevent occurrence of micro-offset.

Still further, in the invention, it is preferable that a circumferential length of the transfuse roller from the first nip area which is formed by the transfuse roller and the secondary transfer member pressing, to the second nip area which is formed by the transfuse roller and the pressure member pressing, is 50 mm or more.

According to the invention, the circumferential length of the transfuse roller from the first nip area to the second nip area is 50 mm or more, whereby it is possible to sufficiently preheat toner transferred from the intermediate transfer section by the transfuse roller before the toner is transferred to a recording medium. Consequently, it becomes possible to secure a sufficiently good fix level of a toner image on a recording medium even if a fixing temperature is relatively low, and obtain an image of high quality.

Still further, in the invention, it is preferable that the intermediate transfer section includes an intermediate transfer belt to which a toner image is primarily transferred from the toner bearing member, and volume resistivity of the intermediate transfer belt is in a range of from $1\times10^7$ Ω·cm to $1\times10^9$ Ω·cm.

According to the invention, the intermediate transfer section includes the intermediate transfer belt, and the volume resistivity of the intermediate transfer belt is set to fall in a range of from $1\times10^7$ Ω·cm to $1\times10^9$ Ω·cm, whereby charge of the intermediate transfer belt is suppressed, and it is possible to make toner separate in a favorable condition when thermally transferring a toner image from the intermediate transfer belt to the transfuse roller.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
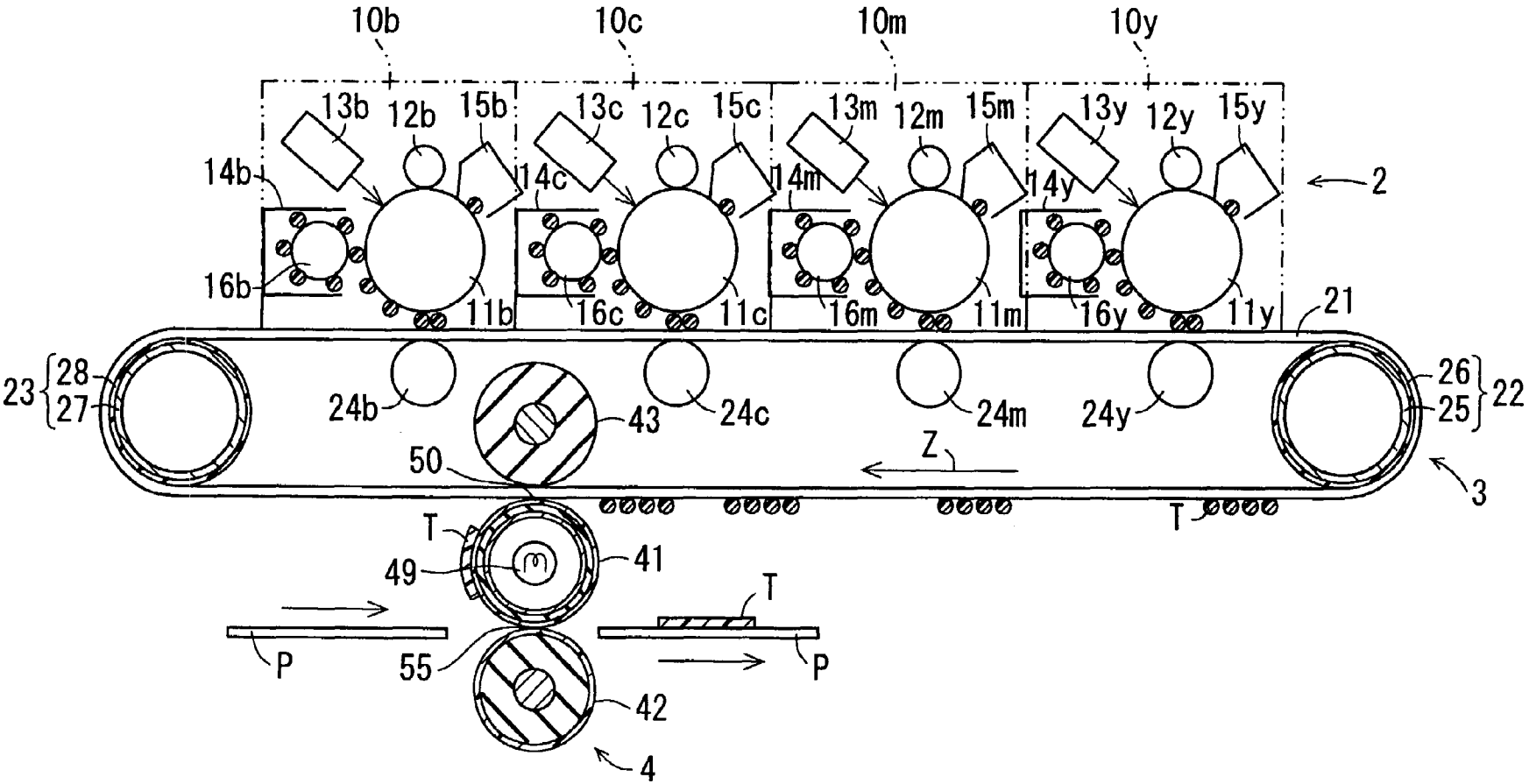
FIG. 1 is a view illustrating a configuration of an image forming apparatus according to one embodiment of the invention.

Now referring to the drawings, preferred embodiments of the invention are described below.

FIG. 1 is a view illustrating a configuration of an image forming apparatus 1 according to one embodiment of the invention. The image forming apparatus 1 is a so-called tandem color laser printer that forms a monochrome image or a full-color image formed by sequentially overlaying toner images of four colors of black, cyan, magenta and yellow, on a recording medium such as a recording sheet, for example, according to image information inputted from an external apparatus such as a personal computer.

In brief, the image forming apparatus 1 comprises an image forming section 2 that forms a toner image, an intermediate transfer section 3 to which a toner image (denoted by reference symbol T in the drawing) is primarily transferred, and a transfuse section 4 to which a toner image is secondarily transferred from the intermediate transfer section 3 and which thirdly transfers the transferred toner image to a recording medium P and fixes to the recording medium P.

The image forming section 2 includes image forming units 10*b*, 10*c*, 10*m* and 10*y* arranged in this order from upstream in a direction of arrow z that is a direction in which an intermediate transfer belt 21 included in the intermediate transfer section 3 described later is rotationally driven. Since the image forming units 10*b*, 10*c*, 10*m* and 10*y* have the same configurations except using black toner, cyan toner, magenta toner and yellow toner, respectively, corresponding portions will be denoted by the same reference numerals, and moreover, the individual units will be expressed by attaching "b" representing black, "c" representing cyan, "m" representing magenta and "y" representing yellow to the ends of the reference numerals as indicators representing the toner colors.

The image forming units and the respective portions of the image forming units will be denoted by only the reference numerals in a case where generically called, and will be denoted by attaching the alphabetical letters representing the toner colors described above to the ends of the reference numerals in a case where illustrated for the individual units.

Since the image forming units 10 have the same configurations as described above, a configuration of the image forming unit 10*b* using black toner will be described as a representative, and descriptions of the other image forming units will be omitted.

Figure 2:
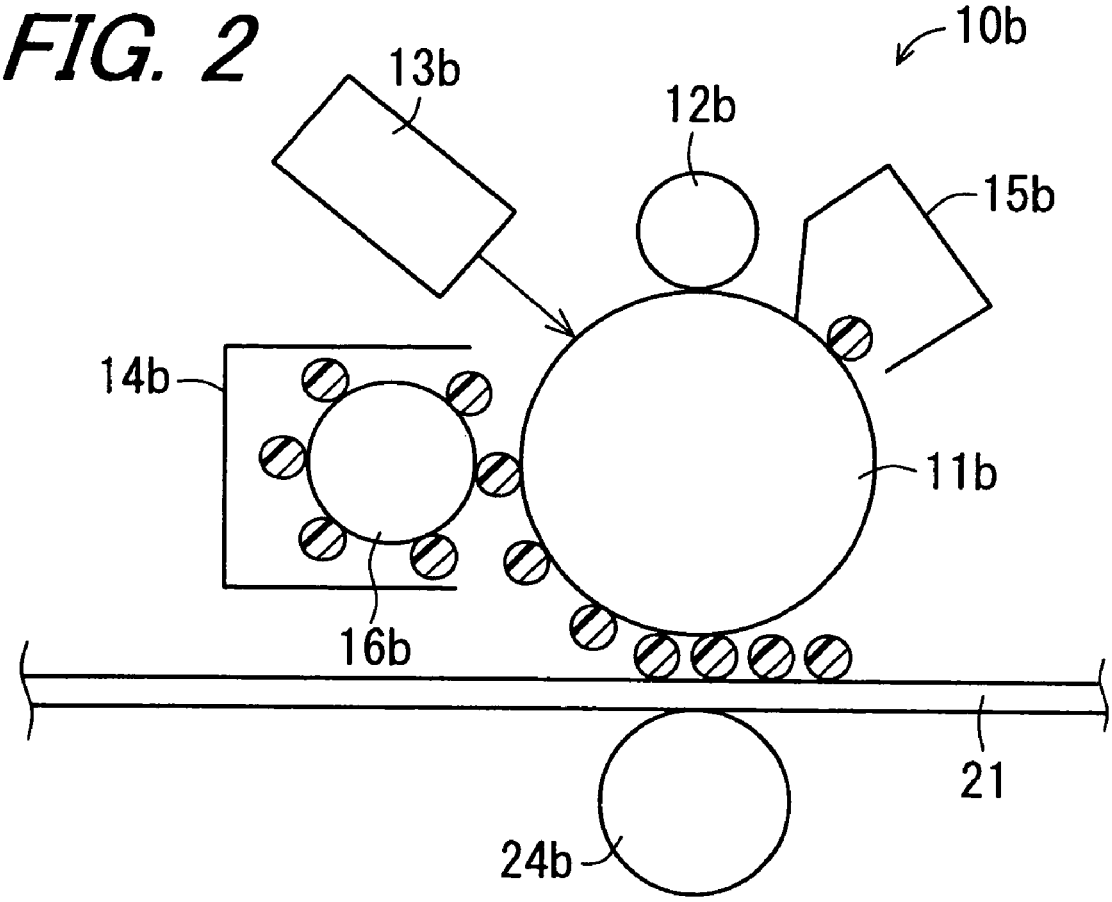
FIG. 2 is an enlarged view illustrating a configuration of an image forming unit.

FIG. 2 is an enlarged view illustrating the configuration of the image forming unit 10*b*. The image forming unit 10*b* includes a photoreceptor drum 11*b* serving as a toner image bearing member, a charging device 12*b*, an exposure unit 13*b*, a developing device 14*b*, and a cleaner unit 15*b*.

The photoreceptor drum 11*b* is a roller-shaped member arranged in an upper part of the image forming apparatus 1 and supported so as to be freely rotated around an axis thereof by a driving mechanism (not illustrated) and, on a surface thereof, has a photosensitive layer for forming an electrostatic latent image corresponding to image information by irradiation of a laser beam from the exposure unit 13*b*.

The charging device 12*b* is a charging member for uniformly charging the surface of the photoreceptor drum 11*b* to a predetermined potential. As the charging device 12*b*, it is possible to use any of types of a roller type and a brush type as contact type, a charger type and so on.

The exposure unit 13*b* is constituted by a laser scanning unit (LSU). The exposure unit 13*b* irradiates the uniformly charged photoreceptor drum 11*b* with a laser beam corresponding to image information for exposure, thereby forming an electrostatic latent image corresponding to black image information on the surface of the photoreceptor drum 11*b*.

The developing device 14*b* supplies toner of a developer held in a developer tank from a developing roller 16*b* to the electrostatic latent image formed on the surface of the photoreceptor drum 11*b*, thereby making the image visible, that is, forming a toner image. The developing roller 16*b* is disposed so as to face the surface of the photoreceptor drum 11*b* and so as to be capable of rotationally driven around an axis thereof, and charged with electric charge in the developing device 14*b*, thereby supplying toner adhering to a surface of the developing roller 16*b* to the electrostatic latent image formed on the surface of the photoreceptor drum 11*b*.

The cleaner unit 15*b* eliminates and collects toner remaining on the surface of the photoreceptor drum 11*b* after the toner image formed on the surface of the photoreceptor drum 11*b* is primarily transferred to the intermediate transfer section 3.

In the image forming unit 10*b*, the surface of the photoreceptor drum 11*b* that is rotationally driven is uniformly charged by the charging device 12*b*, an electrostatic latent image is formed by irradiation of a laser beam corresponding to image information from the exposure unit 13*b*, and development is performed by supply of black toner from the developing device 14*b* to the electrostatic latent image, whereby a black toner image is formed. After the toner image is primarily transferred to the intermediate transfer section 3, toner remaining on the surface of the photoreceptor drum 11*b* is eliminated, cleaned up and collected by the cleaner unit 15*b*. After that, the same image forming operation is repeatedly executed.

With regard to the image forming units 10 except the image forming unit 10*b*, the image forming unit 10*c* forms a toner image corresponding to cyan image information, the image forming unit 10*m* forms a toner image corresponding to magenta image information, and the image forming unit 10*y* forms a toner image corresponding to yellow image information.

Referring to FIG. 1 again, the intermediate transfer section 3 includes the intermediate transfer belt 21, a driving roller 22, a driven roller 23, and primary transfer rollers 24*b*, 24*c*, 24*m* and 24*y* (expressed by only reference numeral 24 in a case where generically called) disposed so as to correspond to the respective image forming units 10. The intermediate transfer section 3 is arranged so that the intermediate transfer belt 21 serving as a primary transfer medium contacts the photoreceptor drums 11 below the image forming section 2.

The intermediate transfer belt 21 extends over the driving roller 22, the driven roller 23 and the primary transfer rollers 24. The driving roller 22 is provided with a rotation driving mechanism (not illustrated). As the driving roller 22 is rotationally driven around an axis thereof by the rotation driving mechanism, the intermediate transfer belt 21 is rotationally driven in the direction of arrow z.

The driving roller 22 of the present embodiment is constituted by a hollow core metal 25 made of steel whose wall thickness is 0.5 mm, and a coating layer 26 that coats the surface of the hollow core metal 25 and is made of silicone rubber having a thickness of 100 μm, and the driving roller has a diameter of 50 mm. The coating layer 26 is disposed for the purpose of increasing a friction force with the intermediate transfer belt 21 and securing a driving force of the driving roller 22 to the intermediate transfer belt 21. The intermediate transfer belt 21 is wound on the driving roller 22 at a winding angle of about 180°.

The driven roller 23 is constituted by a hollow core metal 27 made of steel and a coating layer 28 as in the case of the driving roller 22, applies tension to the intermediate transfer belt 21 set thereon and makes a driven rotation by a rotation driving force of the driving roller 22 transmitted via the intermediate transfer belt 21.

The primary transfer rollers 24 are rotatably disposed so as to face the photoreceptor drums 11 of the respective image forming units 10 via the intermediate transfer belt 21. Transfer bias having a polarity opposite to those of toner images formed on the surfaces of the photoreceptor drums 11 is applied to the primary transfer rollers 24, and the toner images of the respective colors formed on the respective photoreceptor drums 11 are primarily transferred to the intermediate transfer belt 21 at the primary transfer rollers 24 so as to be sequentially overlaid, whereby a full-color toner image is formed on the intermediate transfer belt 21.

Figure 3:
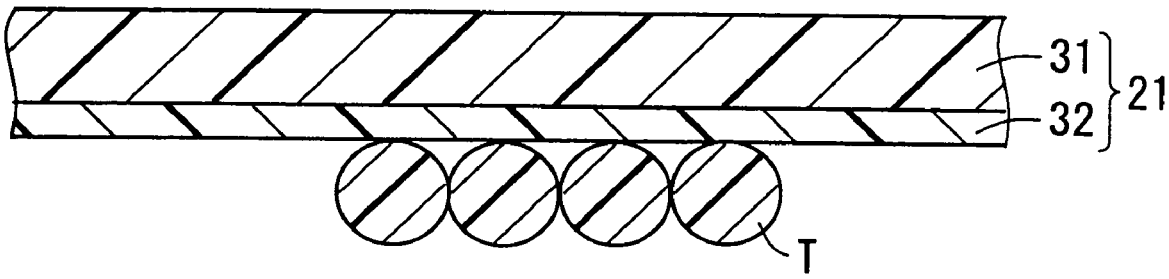
FIG. 3 is a cross section view illustrating a structure of an intermediate transfer belt.

FIG. 3 is a cross section view illustrating a structure of the intermediate transfer belt 21. The intermediate transfer melt 21 has an endless and seamless belt structure, and is constituted by a belt basal member 31 and a release layer 32 formed on an outer peripheral face of the belt basal member 31.

In the present embodiment, the intermediate transfer belt 21 is 500 mm in perimeter. The belt basal member 31 is made of polyimide having a thickness of 90 μm, for example. A conductive filler is mixed into the belt basal member 31, whereby volume resistivity thereof is regulated so as to become $1\times10^7$ Ω·cm or more and $1\times10^9$ Ω·cm or less. As the conductive filler, carbon black or the like is used. The volume resistivity can be measured with, for example, "HIRESTA UP" (produced by Dia Instruments Co., Ltd.).

By using the intermediate transfer belt 21 whose volume resistivity is within a range of from $1\times10^7$ Ω·cm to $1\times10^9$ Ω·cm, charge of the intermediate transfer belt 21 is suppressed and, at a first nip area 50 that is a pressure-contact portion formed when a secondary transfer roller 43 presses against a transfuse roller 41 described later, toner separates from the intermediate transfer belt 21 in a favorable condition when thermally transferred (secondarily transferred) to the transfuse section 4.

In a case where the volume resistivity of the intermediate transfer belt 21 is more than $1\times10^9$ Ω·cm, once a charge potential of the intermediate transfer roller 21 increases (mainly, bias for transfer is applied at the primary transfer rollers 24, and the intermediate transfer belt is charged at the moment), the potential is hard to decrease. As a result, the intermediate transfer belt 21 has a potential opposite to a charge potential of toner, the toner is electrostatically attracted to the intermediate transfer belt 21, and the toner is hard to separate from the intermediate transfer belt 21.

In a case where the volume resistivity of the intermediate transfer belt 21 is less than $1\times10^7$ Ω·cm, at the time of primary transfer in which toner is transferred from the photoreceptor drums 11 onto the intermediate transfer belt 21, toner scattering occurs because of the low volume resistivity of the intermediate transfer belt 21, with the result that transfer efficiency decreases, and decrease in image quality is induced because the scattered toner contaminates the inside of the apparatus and a recording sheet. Accordingly, the volume resistivity of the intermediate transfer belt 21 is set within the range of from $1\times10^7$ Ω·cm to $1\times10^9$ Ω·cm, and preferably, set to $1\times10^8$ Ω·cm.

In the present embodiment, the release layer 32 is formed by an application layer containing PFA, namely, a perfluoroalkoxy resin. The release layer 32 is formed so as to have a thickness of, for example, 10 μm and surface roughness Ra (arithmetical mean roughness Ra specified by JIS-B0601) of 0.6 μm or less. By forming the release layer 32 of PFA coating as a surface layer of the intermediate transfer belt 21, it is possible to make toner separate in a more favorable condition in secondary transfer from the intermediate transfer belt 21 to the transfuse section 4.

Figure 4:
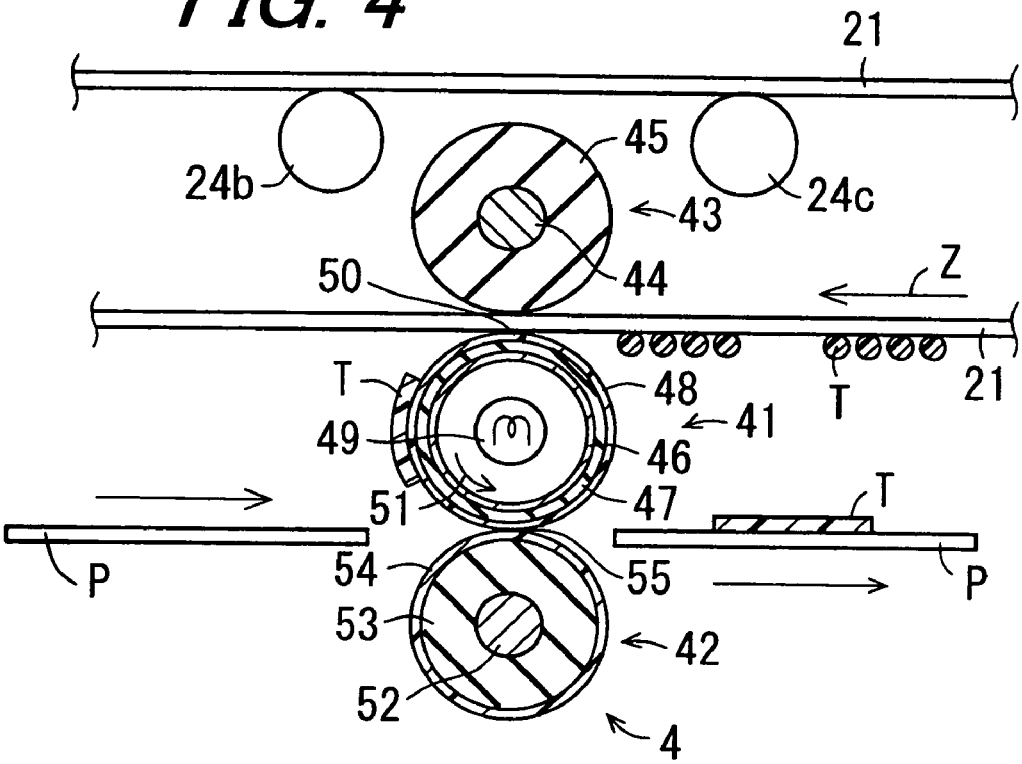
FIG. 4 is an enlarged view illustrating a configuration of a transfuse section.

FIG. 4 is an enlarged view illustrating a configuration of the transfuse section 4. The transfuse section 4 includes the transfuse roller 41 to which a toner image is secondarily transferred from the intermediate transfer belt 21, and a pressure roller 42 serving as a pressure member pressing against the transfuse roller 41. The secondary transfer member, namely, the secondary transfer roller 43 is disposed so as to press against the transfuse roller 41 of the transfuse section 4 via the intermediate transfer belt 21.

The transfuse section 4 is disposed so that the transfuse roller 41 and the pressure roller 42 are aligned in this order above and below, on a downstream side in the rotation driving direction z of the intermediate transfer belt 21 with respect to the yellow image forming unit 10*y*, below and almost midway between the black image forming unit 10*b* and the cyan image forming unit 10*c*.

The secondary transfer roller 43 of the present embodiment pressing against the transfuse roller 41 has a core metal 44 made of aluminum having a columnar shape and an elastic layer 45 made of foamed silicone rubber which is formed on an outer peripheral face of the core metal 44. For example, the secondary transfer roller 43 is 40 mm in outer diameter, and the elastic layer 45 is 5 mm in thickness.

It is preferred that the elastic layer 45 of the secondary transfer roller 43 has a hardness of 30 through 60 degrees in Asker C (load 9.8 N). By setting the hardness of the secondary transfer roller 43 to 30 through 60 degrees in Asker C (load 9.8 N), it is possible to form a uniform and wide nip area even at a low pressure force, and realize favorable thermal transfer efficiency. In a case where the hardness in Asker C of the elastic layer 45 is less than 30 degree, there is a problem with durability because the secondary transfer roller 43 causes plastic deformation. On the other hand, in a case where the hardness in Asker C of the elastic layer 45 is more than 60 degree, the secondary transfer roller 43 is so hard that it is impossible to secure a sufficient nip width (a distance in a circumference direction of the nip area), with the result that transfer efficiency becomes bad, and hollow defects due to increase of surface pressure occur.

The secondary transfer roller 43 is arranged inside the intermediate transfer belt 21 and above the transfuse roller 41, and presses against the transfuse roller 41 arranged outside the intermediate transfer belt 21 via the intermediate transfer belt 21 by a pressuring mechanism (not illustrated), whereby the first nip area 50 is formed.

The transfuse roller 41 includes a hollow core metal 46, an intermediate layer 47 formed on an outer peripheral surface of the hollow core metal 46, an application layer 48 formed on the intermediate layer 47, and a heater 49 serving as a roller heating source disposed inside the hollow core metal 46. The transfuse roller 41 is rotationally driven in a direction of arrow 51 by a rotation driving mechanism (not illustrated).

In the present embodiment, the transfuse roller 41 is formed so as to have an outer diameter of 40 mm. The hollow core metal 46 is a tube made of aluminum having a thickness of 3 mm, for example. The intermediate layer 47 is, for example, a rubber layer made of silicone rubber, and a hardness in Asker C (load 9.8 N) thereof is set to 70 trough 90 degrees.

In the case of using a silicone rubber material whose hardness is A5 degree in the spring type hardness test specified by JIS-K6301 and whose thickness is 1.5 mm, it is possible to set the hardness in Asker C (load 9.8 N) to 70 degree. In the case of using a silicone rubber material whose hardness is A20 degree in the spring type hardness test specified by JIS-K6301 and whose thickness is 0.5 mm, it is possible to set the hardness in Asker C (load 9.8 N) to 90 degree.

In a case where the intermediate layer 47 is formed with rubber whose hardness is within the above range, a deformation follow-up property of the intermediate layer 47 to minute asperities on a surface of a recording sheet is good, and hence, it is possible to prevent occurrence of a failure in image quality called micro-offset, and obtain an image of quality. Here, micro-offset is a phenomenon such that a rubber layer and a toner layer of a roller cannot sufficiently contact recesses of a recording sheet and toner at the recesses peels off after a transfuse process.

The hardness in Asker C (load 9.8 N) of the rubber layer forming the intermediate layer 47 constituting the transfuse roller 41 is within the range of from 70 through 90 degrees, and it is preferred that the hardness is 80 degree. Assuming that the rubber layer has rather high breaking strength and also has deformability in consideration of prevention of occurrence of micro-offset and durability of the intermediate layer 47, it is preferred to use rubber whose hardness is A20 degree specified by JIS-K6301, which is the lower limit to be durable. Moreover, in consideration of thickness as the intermediate layer 47 of the roller, it is preferred that the hardness in Asker C (load 9.8 N) is 80 degree.

As an outermost layer of the transfuse roller 41, the application layer 48 of PFA is formed. Application of PFA allows forming a thin layer. For example, in the case of forming the outermost layer of the roller with a tube, it is only possible to form a layer of 20 μm to 30 μm in thickness because of a manufacturing process and a material. However, in the case of forming by application, it is possible to form a layer of 10 μm in thickness.

By forming the thin PFA application layer 48, it is possible to increase the deformation follow-up property to asperities on a surface of a recording sheet without canceling elasticity of the intermediate layer 47. Therefore, it is possible to prevent occurrence of micro-offset, and it is possible to sufficiently exert a scraping-off force of scraping off toner by shear deformation of the intermediate layer 47 and realize highly efficient transfer. Moreover, since the PFA application layer 48 has excellent toner releasability, it is possible to form an image of quality on a recording sheet without causing toner offset.

The heater 49 disposed inside the hollow core metal 46 is, for example, a halogen lamp. A heating temperature of the transfuse roller 41 is set and controlled by a temperature sensor disposed near the transfuse roller 41 and a control power source that controls on/off operations of the heater 49 in response to detection outputs of the temperature sensor, but the temperature sensor and the control power source are not illustrated in the drawing.

The secondary transfer roller 43 presses against the transfuse roller 41 via the intermediate transfer belt 21, whereby the first nip area 50 as a pressure-contact area of both the rollers is formed. The transfuse roller 41 and the secondary transfer roller 43 press against each other so that pressure at the first nip area 50 becomes 5.3 N/cm$^2$ to 20 N/cm$^2$, and preferably, becomes 12 N/cm$^2$.

In a case where the pressure at the first nip area 50 is less than 5.3 N/cm$^2$, it is impossible to secure a stable nip width because of insufficient surface pressure, with the result that a failure in transfer due to low thermal transfer efficiency occurs, and the failure in transfer extremely deteriorates color reproducibility. On the other hand, in a case where the pressure at the first nip area 50 is more than 20 N/cm$^2$, there arises a problem that deterioration of images occurs because of toner filming and hollow defects, and that plastic deformation of the secondary transfer roller 43 occurs easily and the life of the roller gets short.

Grounds for calculation of the range of the pressure at the first nip area 50 will be explained below. The nip width formed at the first nip area 50 is 0.4 cm to 0.5 cm. In consideration of strength of the secondary transfer roller 43 (plastic deformation of elastic rubber occurs when a pressure force is too high) and thermal transfer efficiency, a favorable value of force given for forming the nip area is about 40 N to 120 N on one side. Converting this value into surface pressure, a minimum value is given by an expression (1), and a maximum value is given by an expression (2). In the expressions (1) and (2), "30 cm" is a length of the nip, namely, a length of the roller.

$$40\ N\times 2/(0.5\ \text{cm}\times 30\ \text{cm})=5.3\ N/\text{cm}^2 \quad (1)$$

$$120\ N\times 2/(0.4\ \text{cm}\times 30\ \text{cm})=20\ N/\text{cm}^2 \quad (2)$$

Further, at the first nip area 50, the intermediate transfer belt 21 is rotationally driven in the direction of arrow z, the transfuse roller 41 is rotationally driven in the direction of arrow 51, and a ratio of a driving speed Vb of the intermediate transfer belt 21 to a driving speed Vr of the transfuse roller (Vb/Vr; referred to as a driving speed ratio hereafter) is set to 1.02 to 1.04. Consequently, it is possible to increase the efficiency of secondary transfer of a toner image from the intermediate transfer belt 21 to the transfuse roller 41.

The following is presumed to be a reason for increase of the transfer efficiency by virtue of setting of the driving speed ratio (Vb/Vr) in a range of from 1.02 to 1.04.

Since the speed Vr of the transfuse roller 41 is slower than the speed Vb of the intermediate transfer belt 21, a rubber part of the intermediate layer 47 of the transfuse roller 41 is stressed in the opposite direction to the rotation driving direction at the first nip area 50 so that shear deformation is caused. However, after passing through the first nip area 50, the intermediate layer 47 recovers from a sheared state and returns to its original shape. Force for returning to the original shape of the intermediate layer 47 of the transfuse roller 41 becomes a scrape-off force of scraping off toner from the surface of the intermediate transfer belt 21, with the result that the transfer efficiency increases.

In a case where the driving speed ratio (Vb/Vr) is less than 1.02, it is impossible to cause sufficient shear deformation of the intermediate layer 47 in the transfuse roller 41, with the result that an effect of scraping off toner gets weak, and it is impossible to obtain sufficient transfer efficiency. On the other hand, in a case where the driving speed ratio (Vb/Vr) is more than 1.04, the intermediate layer causes excessive shear deformation, with the result that a lateral ruck is generated in parallel to an axial direction of the transfuse roller 41 and decreases image quality, and a white line caused by elongation of an image due to a difference in speed is formed outstandingly.

A full-color toner image formed by primarily transferring toner images of the respective colors formed on the photoreceptor drums 21 of the respective image forming units 10 onto the intermediate transfer belt 21 so as to be sequentially overlaid by the respective primary transfer rollers 24 reaches the first nip area 50 formed by the secondary transfer roller 43 and the transfuse roller 41, in accordance with rotation of the intermediate transfer belt 21 in the direction of arrow z.

The toner image reaching the first nip area 50 is thermally transferred onto the transfuse roller 41 by the action of heat of the transfuse roller 41. At this moment, it is possible to transfer the toner image with high transfer efficiency from the intermediate transfer belt 21 to the transfuse roller 41 because, as described before, the pressure at the first nip area 50 is set within the favorable range, the surface layer of the intermediate transfer belt 21 is made with PFA having excellent releasability, and the driving speed ratio (Vb/Vr) is set within the favorable range.

The pressure roller 42 includes a core metal 52, an elastic layer 53 formed on an outer peripheral face of the core metal 52, and a coating layer 54 formed on an outer peripheral face of the elastic layer 53. In the present embodiment, the pressure roller 42 is formed so as to have an outer diameter of 40 mm. The core metal 52 is made of aluminum and formed into a columnar shape. The elastic layer 53 is formed by silicone rubber. The coating layer 54 is formed by a PFA tube. In a case where a halogen lamp is installed inside the core metal so as to be ready for a high-speed process, a hollow-type core metal is used.

The pressure roller 42 presses against the transfuse roller 41 by a pressure mechanism (not illustrated), whereby a second nip area 55 that is a pressure-contact portion with the transfuse roller 41 is formed. The second nip area 55 is formed opposite the first nip area 50 formed between the secondary transfer roller 43 and the transfuse roller 41, at an angle of almost 180° on a circumference of the transfuse roller 41.

The transfuse roller 41 and the pressure roller 42 press against each other so that pressure at the second nip area 55 becomes 13.3 N/cm$^2$ to 33.3 N/cm$^2$, and preferably, becomes 22 N/cm$^2$.

In a case where the pressure at the second nip area 55 is less than 13.3 N/cm$^2$, the intermediate layer 47 of the transfuse roller 41 cannot be deformed because the surface pressure is insufficient, and cannot exhibit a deformation follow-up property to recesses of a recording sheet, with the result that micro-offset occurs noticeably. In a case where the pressure at the second nip area 55 is more than 33.3 N/cm$^2$ on the contrary, it is possible to prevent occurrence of micro-offset, and increase a fix level. However, after a continuous rotation driving time exceeds 500 hours or so, there arises a phenomenon such that the PFA application layer 48 of the transfuse roller 41 peels off the rubber layer, namely, the intermediate layer 47, and there arises a problem such that the intermediate layer 47 peels off the hollow core metal 46 of the transfuse roller 41.

Grounds for calculation of a range of the pressure at the second nip area 55 will be explained below. A nip width formed at the second nip area 55 is 0.4 cm to 0.5 cm. Force given for formation of the nip area needs to be large to a certain degree, in consideration of strength of the roller (the coating of the surface layer peels off and the rubber peels off the core metal when a pressure force is too high), and in order to secure a transfuse property and effectively prevent occurrence of micro-offset. Considering the above in total, a favorable value of the force is about 100 N to 200 N on one side.

Converting this value into surface pressure, a minimum value is given by an expression (3), and a maximum value is given by an expression (4). In the expressions (3) and (4), "30 cm" is a length of the nip, namely, a length of the roller.

$$100\ N\times 2/(0.5\ \text{cm}\times 30\ \text{cm})=13.3\ N/cm^2 \quad (3)$$

$$200\ N\times 2/(0.4\ \text{cm}\times 30\ \text{cm})=33.3\ N/cm^2 \quad (4)$$

Taking intermediate values of the nip width and the force, the nip width is 0.45 cm, and the force is 150 N on one side, whereby it is possible to obtain 22 N/cm$^2$ as an optimum value of the pressure at the second nip area 55.

A toner image transferred from the intermediate transfer belt 21 onto the transfuse roller 41 at the first nip area 50 of the transfuse roller 41 is conveyed to the second nip area 55 by rotation in the direction of arrow 51 of the transfuse roller 41. In the process of conveyance from the first nip area 50 to the second nip area 55, toner on the transfuse roller 41 is sufficiently heated by the transfuse roller 41. Therefore, reproducibility of an image of dots and thin lines is increased by a moderate thermal cohesion action, and solid density of a solid image is increased by filming by virtue of the action of a pulling force among toner particles, with the result that it is possible to obtain an image of considerably high quality.

Accordingly, a distance from the first nip area 50 to the second nip area 55 on the outer peripheral face of the transfuse roller 41 is important to sufficiently heat the toner on the transfuse roller 41. By making the distance from the first nip area 50 to the second nip area 55 long, it is possible to make a time to heat the toner long, so that it is possible to sufficiently melt the toner on the surface of the transfuse roller 41.

In an image forming apparatus assumed by the invention in which a process speed is 100 mm/sec to 400 mm/sec in a high-speed process, it is possible, by setting the distance from the first nip area 50 to the second nip area 55 to 50 mm or more, to sufficiently heat the toner on the transfuse roller 41 and exhibit the above effects.

In the present embodiment, the first nip area 50 and the second nip area 55 are formed so as to be opposed to each other at an angle of 180° on the outer peripheral face of the transfuse roller 41. Therefore, setting the distance from the first nip area 50 to the second nip area 55 to 50 mm or more is setting a perimeter of the transfuse roller 41 to 100 mm (50 mm×2) or more. Since the outer diameter of the transfuse roller 41 of the present embodiment is 40 mm as described before, the perimeter thereof is 40 mm×3.14=125.6 mm. Thus, the perimeter is set to 100 mm or more.

The toner image on the transfuse roller 41 conveyed to the second nip area 55 in accordance with rotation of the transfuse roller 41 is, at the second nip area 55, thirdly transferred onto a recording sheet P conveyed to the second nip area 55 by a sheet conveying portion (not illustrated), and fixed by heating and pressuring by the transfuse roller 41 and the pressure roller 42, thereby becoming a final image.

At the second nip area 5, the nip width is a proper width for heating (about 4 mm to 5 mm), and it is possible to transfer and fix the toner image while heating the recording sheet P conveyed into the second nip area 55. Therefore, at this moment, a rapid decrease in temperature of toner does not occur at an interface between the toner and the recording sheet P, and the toner sufficiently melted in advance in the process of conveyance by the transfuse roller 41 penetrates far into fiber of the recording sheet P, which allows obtaining a final image having a high fix level by an anchor effect.

Since the image forming apparatus 1 thus allows heating and sufficiently melting the toner before third transfer on the outer peripheral face of the transfuse roller 41 in the process of conveyance of the toner image from the first nip area to the second nip area 55, it is possible to obtain a sufficient fix level when a fixing temperature of the transfuse roller 41 is set to about 180° C. even when a process speed is 400 mm/sec, which is the assumed maximum speed. Accordingly, it is possible to largely decrease the amount of electric power consumed by the fixing portion of the image forming apparatus 1, whereby it is possible to hold down the maximum power consumption to 1.5 kVA (100V, 15 A) or less, and it becomes possible to introduce the image forming apparatus 1 to an ordinary office and home.

Further, since the image forming apparatus 1 performs secondary transfer and third transfer by the thermal transfer action, a problem peculiar to electric field transfer, such as occurrence of toner scattering or residual toner on the intermediate transfer belt (decrease transfer efficiency), does not occur. Accordingly, it is possible to efficiently consume toner, so that it is unnecessary to dispose a mechanism for collecting waste toner produced on the intermediate transfer belt or a cleaning mechanism for the intermediate transfer belt.

The invention is not limited to the above embodiment, and may include various modified examples. For example, although the image forming apparatus 1 illustrated in the present embodiment is a color laser printer, the image forming apparatus is not limited thereto, and may be a monochrome image forming apparatus such as a monochrome laser printer, an image forming apparatus formed as a color copier, or an image forming apparatus formed as a multifunction peripheral provided with a plurality of functions such as a printer, a copier and a scanner. Moreover, although the illustrated intermediate transfer medium of the intermediate transfer section is the intermediate transfer belt, the intermediate transfer medium is not limited thereto, and may be a drum-shaped one.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a toner image bearing member provided in an image forming section for forming a toner image containing toner of one or two or more colors, for carrying the toner image;

an intermediate transfer section to which the toner image is primarily transferred from the toner image bearing member;

a transfuse section to which the toner image is secondarily transferred from the intermediate transfer section and which thirdly transfers and fixes the transferred toner image to a recording medium; and a secondary transfer member disposed so as to press against the transfuse section through contact with the intermediate transfer section, wherein pressure at a first nip area as a pressure-contact area formed by the transfuse section and the secondary transfer member pressing against the transfuse section through contact with the intermediate transfer section is in a range of from 5.3 $N/cm^2$ to 20 $N/cm^2$, and the transfuse section and the intermediate transfer section are configured to be driven at such speeds that a driving speed of the intermediate transfer section is higher than a driving speed of the transfuse section, wherein a ratio of the driving speed of the intermediate transfer section to the driving speed of the transfuse section is in a range of from 1.02 to 1.04.

2. The image forming apparatus of claim 1, wherein the transfuse section includes a transfuse roller to which a toner image is secondarily transferred from the intermediate transfer section, and the transfuse roller has at least a rubber layer, and the rubber layer has a hardness of 70 through 90 degrees in Asker C.

3. The image forming apparatus of claim 2, wherein the transfuse roller has a surface layer made of a copolymer of tetrafluoroethylene and perfluoroalkyl vinyl ether.

4. The image forming apparatus of claim 2, wherein the transfuse section includes a pressure member pressing against the transfuse roller, and pressure at a second nip area as a pressure-contact area formed by the transfuse roller and the pressure member pressing is in a range of from 13.3 $N/cm^2$ to 33.3 $N/cm^2$.

5. The image forming apparatus of claim 4, wherein a circumferential length of the transfuse roller from the first nip area which is formed by the transfuse roller and the secondary transfer member pressing, to the second nip area which is formed by the transfuse roller and the pressure member pressing, is 50 mm or more.

6. The image forming apparatus of claim 1, wherein the intermediate transfer section includes an intermediate transfer belt to which a toner image is primarily transferred from the toner bearing member, and volume resistivity of the intermediate transfer belt is in a range of from $1\times10^7$ Ω·cm to $1\times10^9$ Ω·cm.

* * * * *